US009107276B2

(12) United States Patent
Riederer et al.

(10) Patent No.: US 9,107,276 B2
(45) Date of Patent: Aug. 11, 2015

(54) METHOD OF DRIVING AN ARC-DISCHARGE LAMP

(75) Inventors: Xaver Riederer, Aachen (DE); Lars Dabringhausen, Aachen (DE)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 456 days.

(21) Appl. No.: 13/642,993

(22) PCT Filed: Apr. 21, 2011

(86) PCT No.: PCT/IB2011/051742

§ 371 (c)(1),
(2), (4) Date: Oct. 23, 2012

(87) PCT Pub. No.: WO2011/135493

PCT Pub. Date: Nov. 3, 2011

(65) Prior Publication Data

US 2013/0038220 A1 Feb. 14, 2013

(30) Foreign Application Priority Data

Apr. 29, 2010 (EP) ..... 10161405

(51) Int. Cl.
*H05B 41/00* (2006.01)
*H05B 41/292* (2006.01)

(52) U.S. Cl.
CPC ..... *H05B 41/2928* (2013.01)

(58) Field of Classification Search
USPC ..... 315/291, 77, 297, 307, 308, 326
See application file for complete search history.

(56) References Cited

U.S. PATENT DOCUMENTS

| | | | | |
|---|---|---|---|---|
| 5,973,457 | A | 10/1999 | Yamashita | |
| 2004/0251852 | A1* | 12/2004 | Kambara et al. | 315/291 |
| 2005/0119796 | A1* | 6/2005 | Steiner et al. | 700/282 |
| 2008/0088253 | A1 | 4/2008 | Bonigk | |
| 2010/0289429 | A1* | 11/2010 | Pollmann-Retsch et al. | 315/307 |

FOREIGN PATENT DOCUMENTS

| | | | |
|---|---|---|---|
| DE | 10200706035 | A1 | 6/2009 |
| EP | 0713352 | A2 | 5/1996 |

(Continued)

*Primary Examiner* — Douglas W Owens
*Assistant Examiner* — Jianzi Chen

(57) ABSTRACT

The invention describes a method of driving an arc-discharge lamp (1), which method comprises the steps of detecting a mechanically induced fluctuation in luminous flux of the lamp (1) occurring as a result of a physical displacement of the discharge arc (2), determining a characteristic (43, 51, 63) of the mechanically induced fluctuation in luminous flux of the lamp (1), and adjusting the lamp power on the basis of the determined characteristic (43, 51, 63) to suppress the mechanically induced fluctuation in luminous flux of the lamp (1). The invention further describes a driver (3) for an arc-discharge lamp (1), which driver comprises a detecting means (40, 50, 60) for detecting a mechanically induced fluctuation in luminous flux of the lamp (1) occurring as a result of a physical displacement of the discharge arc (2), a determination unit (42, 50, 62) for determining a characteristic (43, 51, 63) of the mechanically induced fluctuation in luminous flux of the lamp (1); and an adjustment unit (8) for adjusting a lamp power (Pc) on the basis of the determined characteristic (43, 51, 63) to suppress the mechanically induced fluctuation in luminous flux of the lamp (1). The invention also describes a lighting assembly (9) comprising a high-intensity gas-discharge lamp (1) and such a driver (3) for driving the lamp (1) according to the inventive method.

14 Claims, 6 Drawing Sheets

(56) References Cited

FOREIGN PATENT DOCUMENTS

| | | | |
|---|---|---|---|
| EP | 0830982 | A2 | 3/1998 |
| FR | 2945246 | A2 | 11/2010 |
| JP | 2215090 | A | 8/1990 |
| JP | 4342987 | A | 11/1992 |
| JP | 2004039563 | A | 2/2004 |
| JP | 2009093994 | A | 4/2009 |
| WO | 2005064997 | A1 | 7/2005 |
| WO | 2010100935 | A1 | 9/2010 |

* cited by examiner

METHOD OF DRIVING AN ARC-DISCHARGE LAMP

FIELD OF THE INVENTION

The invention describes a method of driving an arc-discharge lamp, a driver for an arc-discharge lamp, and a lighting assembly.

BACKGROUND OF THE INVENTION

A measure of the performance of a lamp can be given by the efficacy of the lamp in lumens/Watt, i.e. the luminous flux produced by the lamp as a ratio of the power required to produce that luminous flux. For many lighting applications, a constant light-flux—and therefore a constant efficacy—is desirable. For lamps such as high-intensity gas-discharge (HID) lamps that operate by applying an alternating voltage across two electrodes, some fluctuation can occur at the relatively high operating frequency of the lamp. As the lamp ages, the electrode topology changes, causing variations in the length of the discharge arc and an associated fluctuation in lamp voltage, since the lamp voltage is directly related to the length of the discharge arc. It follows that the light output also fluctuates, since the light output is closely related to the lamp voltage. While any fluctuations in light output at these high frequencies cannot be perceived by a human observer, they indicate a drop in performance of the lamp and are therefore undesirable for that reason. Various lamp driver realisations address this problem, for example by briefly increasing the lamp power prior to a commutation of the lamp voltage.

However, fluctuation in the light output at lower frequencies in the range of several tens of Hz can indeed be perceived as annoying. In particular, light output fluctuations in the range 5-20 Hz can be easily detected by a human observer since the eye is particularly sensitive to light fluctuations in this frequency range. An increase or decrease in the light output of only 0.5% can be noticeable. Such perceptible fluctuations can be physically or mechanically induced by an arc movement or displacement inside the discharge vessel, and can result in noticeable beam pattern instabilities. Automotive HID headlamp systems can exhibit such beam pattern instabilities during driving over a bumpy road, e.g. railroad crossing or cobblestone pavement, or in situations when the lamp is subjected to mechanical impact, e.g. when the motor is re-started, when a car door is slammed shut, etc.

In present-day automotive front-lighting systems, the lamp driver operates the lamp in steady state in such a way that the lamp power is kept essentially constant. Different algorithms can be used to stabilize the lamp power, depending on the driver hardware. If the lamp is subject to mechanical impact, for example in one of the situations mentioned above, the arc inside the discharge vessel is displaced, leading to lamp voltage modulations. If the lamp is suddenly displaced, the discharge arc—a plasma extending between the two electrode tips—is moved relative to the discharge vessel. Because of its high temperature, the discharge arc has a lower density than the surrounding gas in the discharge vessel and is therefore lighter. If the lamp is subject to an abrupt downward displacement, for example, the discharge arc is also deflected downwards by the cooler (and therefore heavier) surrounding gas and is therefore shortened. For the same reason, an abrupt upward displacement of the lamp causes the discharge arc to be pushed upward by the cooler, heavier surrounding gas, and is therefore lengthened. As a result, the discharge arc can be 'stretched' or 'compressed', depending on the direction of the spatial displacement of the lamp. The lamp voltage increases or decreases accordingly. During this time, the light output fluctuates to follow the fluctuations in lamp voltage. When a 'slow' power control algorithm is used by the lamp driver, the lamp voltage modulations will lead to lamp power modulations, and these result in a modulation of the integral light flux of the lamp. This modulated light flux leads to a perceptible forefront flicker (FFF) in the beam close to the front of the vehicle. A fast power control algorithm, which is also sometimes implemented in drivers nowadays, is associated with a better performance and results in less severe light flux modulations. Even for such a fast power control algorithm, visible forefront flicker can remain a problem owing to the fluctuation in lamp efficacy while the power control algorithm adjusts the lamp power.

Therefore, it is an object of the invention to provide an improved way of driving an arc-discharge lamp to reduce perceptible forefront beam pattern instabilities.

SUMMARY OF THE INVENTION

The object of the invention is achieved by the method of driving an arc-discharge lamp according to claim 1, the driver for an arc-discharge lamp according to claim 10, and the lighting assembly according to claim 14.

According to the invention, the method of driving an arc-discharge lamp comprises the steps of detecting a mechanically induced fluctuation in luminous flux of the lamp occurring as a result of a physical displacement of the discharge arc, determining a characteristic of the mechanically induced fluctuation in luminous flux of the lamp, and adjusting the lamp power on the basis of the determined characteristic to suppress the mechanically induced fluctuation in luminous flux of the lamp.

A physical displacement or deflection of the discharge arc of the lamp can be caused by a sudden movement or mechanical excitation of the lamp, for example when the lamp is jolted. In the case of an automotive front-lighting lamp, such a jolt or displacement can occur when the car drives over a pothole or other uneven surface. As explained above, the alteration in discharge-arc length results in a modulation of the lamp voltage, which in turn would result in a modulation of the light output, which can persist for a noticeable length of time. An obvious advantage of the method according to the invention is that any mechanically induced fluctuation in luminous flux is quickly suppressed or cancelled out, so that the annoying flicker effect that would otherwise follow a jolt to the lamp is essentially prevented from developing.

According to the invention, the driver for an arc-discharge lamp comprises a detecting means for detecting a mechanically induced fluctuation in luminous flux of the lamp occurring as a result of a physical displacement of the discharge arc, a determination unit for determining a characteristic or parameter of the mechanically induced fluctuation in luminous flux of the lamp; and an adjustment unit for adjusting a lamp power on the basis of the determined characteristic to suppress or compensate the mechanically induced fluctuation in luminous flux of the lamp.

A lighting assembly according to the invention comprises a high-intensity gas-discharge lamp and such a lamp driver.

The dependent claims and the following description disclose particularly advantageous embodiments and features of the invention. Features of the various embodiments may be combined as appropriate to arrive at further embodiments.

Since the forefront flicker is annoying because it is perceptible to a human observer, the step of detecting a mechanically induced fluctuation in luminous flux of the lamp in a particularly preferred embodiment of the invention preferably comprises detecting fluctuations in a frequency range corresponding to the range of sensitivity of the human eye, i.e. in a frequency range between 5 Hz and 30 Hz. In the following, but without restricting the invention in any way, it may be assumed that the lamp is an automotive front headlamp arranged in a light assembly in the front of a vehicle.

The novel approach taken by the invention is based on observations and new insights gained during investigation of forefront flicker. One important observation was that a sudden arc displacement does not only result in a modulation of the lamp voltage, but also causes a modulation of the luminous flux and therefore also of the lamp efficacy. Furthermore, experiments have shown that the fluctuation in luminous flux essentially follows the light voltage fluctuation with a delay depending to some extent on the amplitude of the voltage modulation. For this reason, the known lamp drivers, which strive to keep the lamp power constant by immediately 'correcting' the lamp current to compensate for the change in lamp voltage, cannot suppress the fluctuations in luminous flux and lamp efficacy. Therefore, in a particularly preferred embodiment of the invention, the step of adjusting the lamp power comprises applying a phase-shift to the lamp power correction to effectively cancel out or suppress the fluctuation in luminous flux, which phase-shift is determined on the basis of the determined characteristic. This phase-shifted power correction can be likened to a noise-cancellation algorithm that applies a matching but phase-shifted acoustic signal to cancel out the unwanted signal.

To control the lamp power, the lamp driver generally adjusts the lamp current in keeping with the lamp voltage in order to obtain a desired lamp power value. In the method according to the invention, the observed characteristic of the mechanically induced fluctuation in luminous flux will determine the extent of adjustment necessary. Therefore, in a further preferred embodiment of the invention, the step of adjusting the lamp power comprises adjusting the amplitude of the lamp current and/or the lamp voltage on the basis of the determined characteristic.

There are a number of possible ways to detect a change in luminous flux arising on account of a sudden displacement of the discharge arc. In one preferred embodiment of the invention, the mechanically induced fluctuation in luminous flux of the lamp is detected by monitoring the lamp voltage, since the light output is closely related to the lamp voltage. This approach is also advantageous since essentially all known lamp drivers more or less continually monitor the lamp voltage for their power-control algorithms, making it a fairly straightforward matter to detect a change in lamp voltage.

Lamp voltage values collected over time can then be used to deduce whether a power correction is necessary to suppress a low-frequency fluctuation in luminous flux. In a preferred embodiment of the invention, therefore, the characteristic of the mechanically induced fluctuation in luminous flux of the lamp comprises a lamp voltage modulation envelope, which lamp voltage modulation envelope is derived from a sequence of monitored lamp voltage values. By observing the lamp voltage and measuring its value over time, any discrepancy between 'normal' behaviour and behaviour as a result of a discharge-arc displacement can be relatively easily detected. For example, if the lamp voltage is always measured at a particular instant of the lamp period, this lamp voltage value should always be about the same in a time frame of a few seconds. In case of a sudden arc displacement, however, the lamp voltage becomes disturbed, and the measured lamp voltage values will accordingly exhibit a certain deviation from the expected value. The measured values indicate the trend taken by the lamp voltage as it is caused to fluctuate. This information can be used, as will be explained below, to correct the lamp power and to cancel out the fluctuations in luminous flux.

As outlined in the introduction, a mechanically induced discharge-arc displacement can have several causes such as banging a car door shut, driving over a pothole, railway crossing or other unevenness in the road surface, etc., and the associated abrupt forces can cause the entire lighting assembly, including the lamp, to be suddenly displaced. In another approach, therefore, a mechanically induced fluctuation in luminous flux of the lamp is preferably detected by monitoring an acceleration of the lamp to obtain a lamp acceleration value. The characteristic of the mechanically induced fluctuation in luminous flux of the lamp can be derived by analysing the lamp acceleration values to determine a lamp vibration value, i.e. the frequency at which the lamp (and therefore the discharge arc) vibrates as a result of the impact. Using previously collected lamp calibration values, the vibration can be used to deduce a necessary amplitude and phase correction for the lamp power.

Calibration values can be collected in experiments or trials using several lamps of a particular lamp type, for example a batch of 35 W lamps from a particular manufacturer. The values obtained—for example lamp voltage values, light output values, lamp vibration values—can be processed to determine an algorithm for deriving a lamp power correction to optimally suppress the forefront flicker that would arise as a result of a mechanical impact. Data can be stored in a suitable format, for example in a look-up table in a memory of the driver, and any algorithm can be developed to run on a microprocessor or microcontroller of the driver.

The lamp driver can use the information contained in the measured values of lamp voltage and/or acceleration in a number of ways to cancel out the fluctuation and to rapidly restore a constant level of luminous flux. For example, based on the discovered relationship between lamp voltage fluctuation and luminous flux fluctuation described above, the lamp driver can determine the phase difference between the lamp voltage and the ensuing light output, and can apply a phase-shifted lamp power correction accordingly. Furthermore, the amplitude of the fluctuation of the measured characteristic can be used by the lamp driver to control the extent or degree of the lamp power correction. When the lamp driver is supplied with a sequence of measured lamp voltage/acceleration values, it can directly analyse the values to determine the required phase-shift and amplitude correction to cancel out the luminous flux fluctuation. The lamp driver can base its derivations on previously collected information, for example by using the measured input values to consult a look-up table to deduce a phase-shift and amplitude correction for the lamp power to cancel out the fluctuation in luminous flux.

In another approach, the mechanically induced fluctuation in luminous flux of the lamp can preferably be detected by monitoring a light output of the lamp. Again, this approach is based on the knowledge that, over a time span of a few tens of seconds, the light output by the lamp will, to all intents and purposes, remain essentially constant. Any low-frequency alteration in the light output as a result of a sudden displacement of the discharge arc can easily be detected by measuring the light output using an appropriate light detector or sensor. Usually, such a sensor operates by converting the collected light to a voltage, and the amplitude of the voltage is a direct indication of the light intensity. For example, a sensor such as a photodiode could be placed in a suitable location to collect the light and convert this to a signal, which can then be analysed to determine the amount of deviation from the normal light output level. Therefore, in a preferred embodiment of the invention, the characteristic of the mechanically induced fluctuation in luminous flux of the lamp comprises a measured light output value, which can be directly used to determine the amount by which the lamp power should be corrected to directly cancel out the fluctuations in luminous flux.

Since a lamp driver of an arc-discharge lamp continually monitors the lamp voltage, taking measurements at close intervals, in a preferred embodiment of the invention the detecting means comprises a voltage measurement means such as a voltmeter for measuring the lamp voltage, and this voltage measurement means can simply comprise the voltage measurement means already incorporated in the lamp driver. Such a realisation would be particularly economical, since hardly any alteration would be required in the hardware of the lamp driver.

In addition or as an alternative to such a voltage measurement means, the detecting means can comprise a light sensor for measuring the light output by the lamp. When a light sensor is used to monitor the lamp performance, such a sensor is preferably located in a position that allows it to obtain a realistic measurement of the light output. For example, the light sensor could be located close to the lamp burner. Preferably, however, the sensor could be incorporated in a base of the lamp, since this would require less hardware alteration while still allowing a reliable assessment of any low-frequency variations in light intensity.

Again, in addition or as an alternative to a voltage measurement means/light sensor, in a preferred embodiment of the invention the detecting means can comprise an acceleration sensor for measuring a proper acceleration of the lamp. An acceleration sensor can be, for example, a micro-machined accelerometer that can be mounted on or incorporated in any suitable location, for example in the housing of the lamp. The accelerometer output signal, indicating the proper acceleration of the object to which it is attached, can be directly forwarded to a processor of the lamp driver.

BRIEF DESCRIPTION OF THE DRAWINGS

In the drawings, like numbers refer to like objects throughout. Objects in the diagrams are not necessarily drawn to scale.

DETAILED DESCRIPTION OF THE EMBODIMENTS

Figure 1:
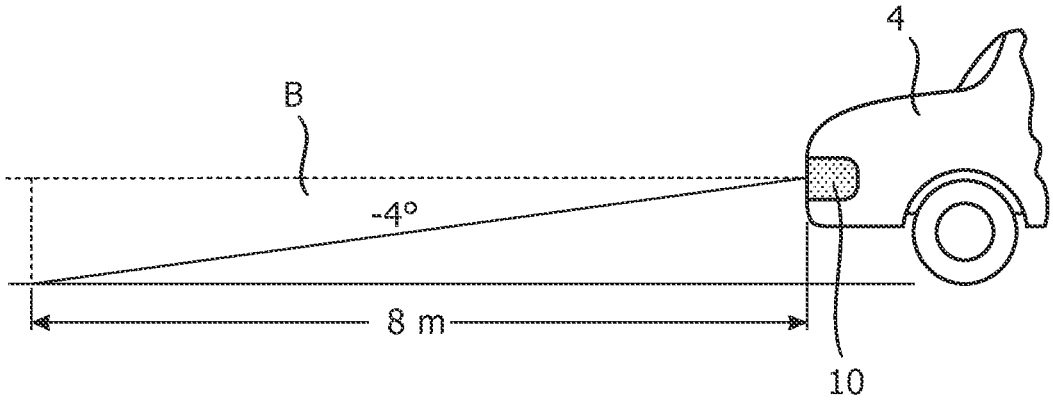
FIG. 1 shows an automobile front beam.

FIG. 1 shows an automobile front beam issued by a front headlamp of a vehicle. For an automobile, the region in which the perceptible and annoying forefront flicker originates is generally up to about 8 metres in front of the vehicle and in the beam region up to about 4° below a horizontal plane of the headlamp.

Figure 2:
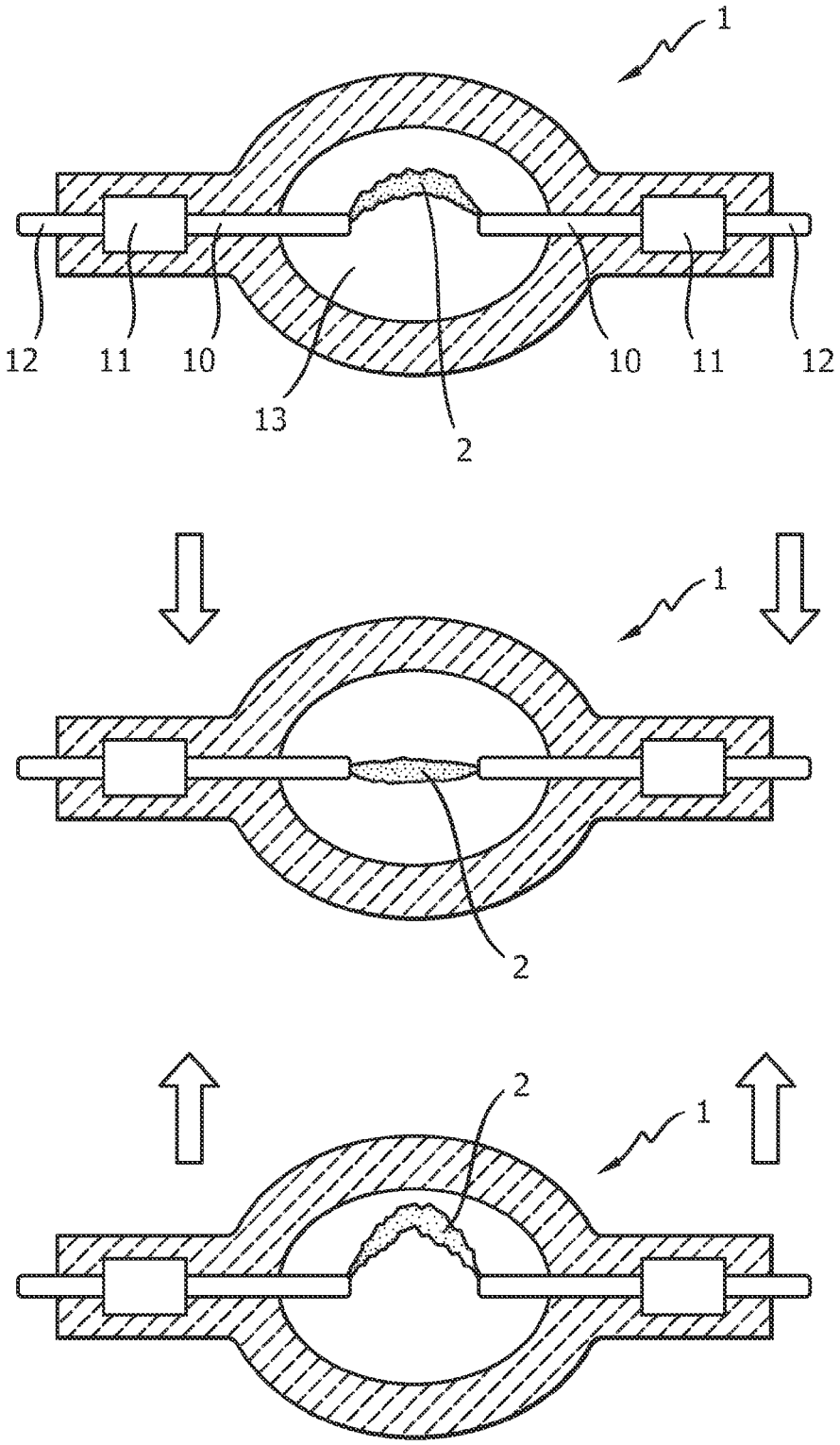
FIG. 2 shows a simplified schematic representation of an arc-discharge lamp with a discharge-arc extending between two electrodes.

FIG. 2 shows a simplified schematic representation of an arc-discharge lamp 1 with a discharge-arc 2 extending between two electrodes 10. In normal operation, as indicated in the upper part of the diagram, owing to an upward convection in the burner, the discharge arc extends as shown between the two electrodes 10. When the lamp 1 is subject to an abrupt downward displacement, shown in the centre part of the diagram and indicated by the downward arrow, the discharge arc 2 is briefly 'shortened' as shown. This shorter discharge-arc is associated with a decrease in lamp voltage, and therefore also with a decrease in luminous flux. Similarly, when the lamp 1 is subject to an abrupt upward displacement, shown in the lower part of the diagram and indicated by the upward arrow, the discharge arc 2 is briefly 'stretched' as shown. This longer discharge-arc is associated with an increase in lamp voltage, and with a corresponding increase in luminous flux. In the diagram, only the effects of an up/down displacement of the lamp are shown. Evidently, the lamp could be subject to a mechanical impact resulting in a lateral displacement of the lamp. In that case, the discharge-arc would also be laterally briefly displaced and correspondingly lengthened or stretched.

Figure 3:
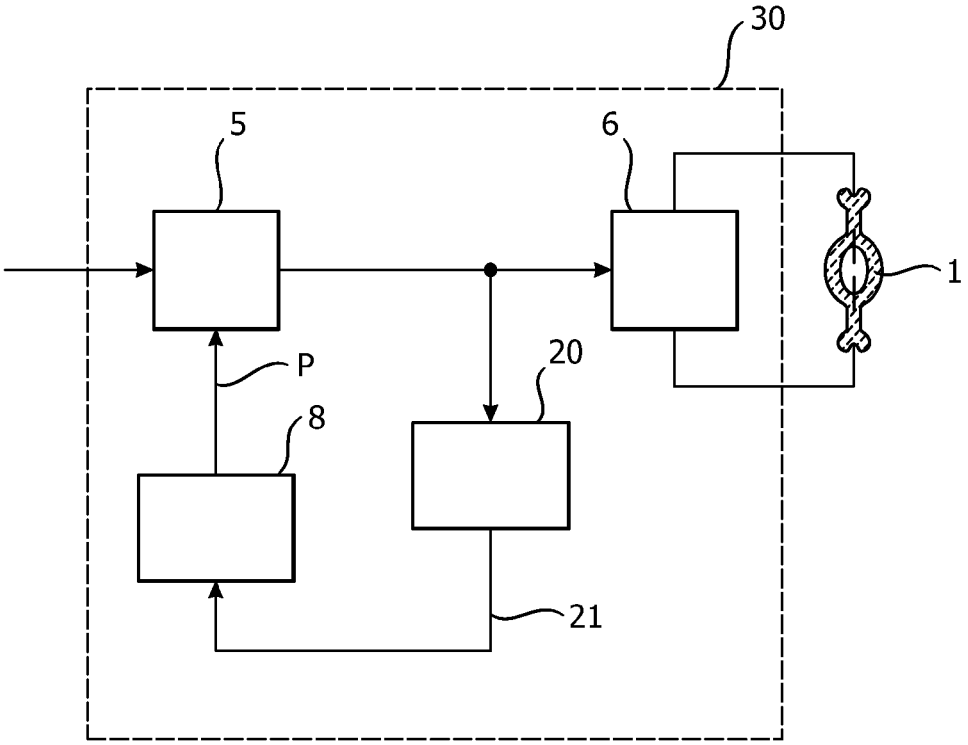
FIG. 3 PRIOR ART
FIG. 3 shows a block diagram of a prior art lamp driver.

FIG. 3 shows a simplified block diagram of a prior art lamp driver 30, comprising a converter 5 for converting an input supply signal (for example from a car battery) to a level suitable for a lamp 1, a commutation unit 6 (generally comprising a H-bridge for commutating the lamp current and an igniter for igniting the lamp). The driver 30 also comprises a voltage measurement unit 20 for monitoring the lamp voltage. The voltage measurement unit 20 forwards the lamp voltage values 21 to a power correction unit 8, which interprets the lamp voltage values 21 to determine any required correction to the lamp current in order to maintain a constant lamp power.

Figure 4:
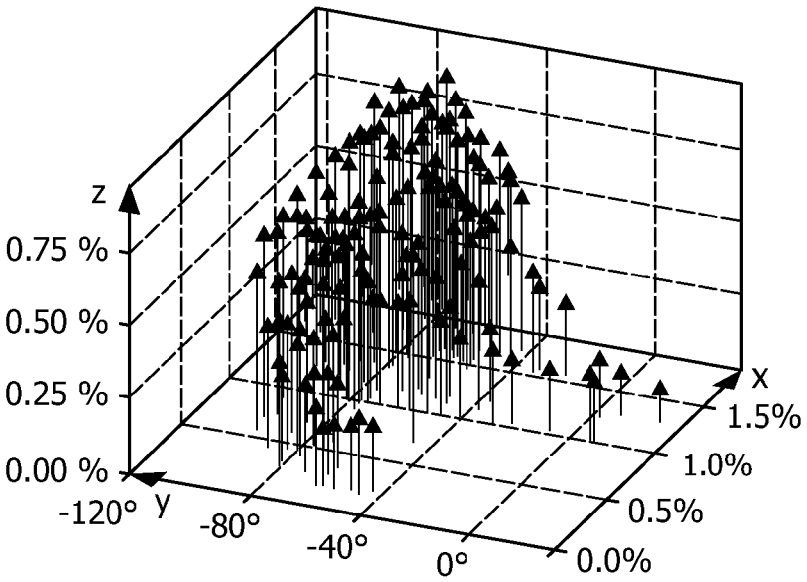
FIG. 4 shows a plot of experimentally obtained light modulation values against lamp modulation values and phase shift.

FIG. 4 shows a plot of experimentally obtained light modulation values (X-axis, in percent) against lamp modulation values (Z-axis, in percent) and phase shift (Y-axis, in degrees) for a lamp driven using a prior art lamp driver such as that described in FIG. 2 above. As the graph shows, a lamp voltage modulation or fluctuation of about 1.0-1.5% results in a light output fluctuation of between 0.5% and 0.75%. The interesting aspect of this plot is that the fluctuation in light output clearly exhibits a distinct phase shift relative to the fluctuation or modulation in lamp voltage. An alteration in lamp voltage causes a corresponding increase or decrease in light output, but this is delayed relative to the lamp voltage alteration. This relationship is the basis for determining the power correction in the method according to the invention. Using this information, measured lamp voltage values (in the embodiment using a voltage measurement means) can be used directly to determine the phase shift required for the lamp power correction. Measured light output values (in the embodiment using a light sensor) can also be used to directly obtain the required phase shift. Similar experimental results can be obtained for acceleration values correlated with lamp voltage fluctuations, so that measured values of acceleration (in the embodiment using an accelerometer) can be used to easily derive the required phase shift. The information thus gathered experimentally can be provided to the lamp driver in a suitable form, for example as a look-up table or as a simple algorithm for using the measured values to derive the required phase shift and amplitude for the power correction.

Figure 5:
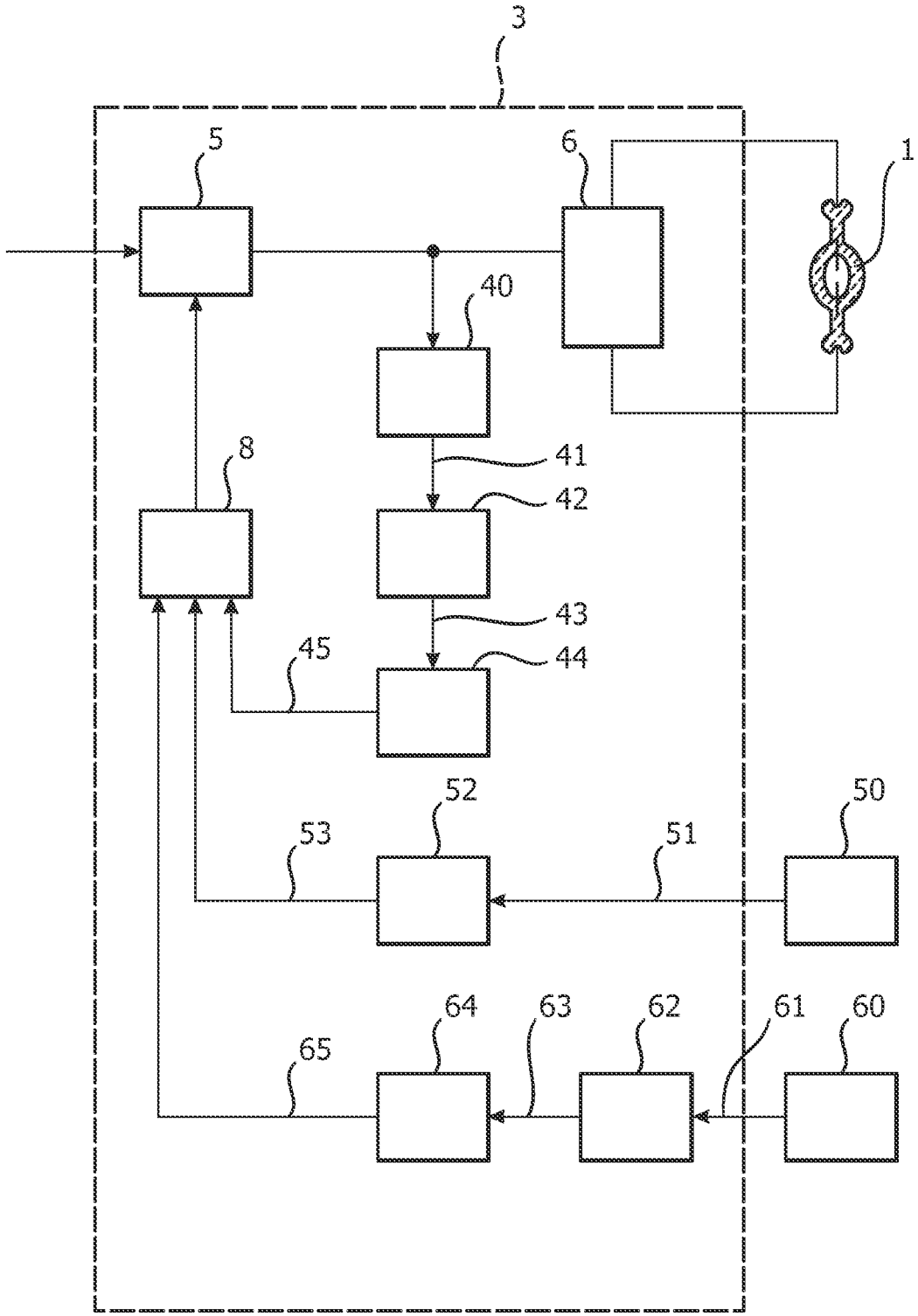
FIG. 5 shows a block diagram of a lamp driver according to an embodiment of the invention.

FIG. 5 shows a block diagram of a lamp driver 3 according to an embodiment of the invention. Again, the lamp driver 3 comprises a converter 5 and a commutation unit 6. This lamp driver 3 also comprises a voltage measurement means 40 for obtaining lamp voltage values 41. These are analysed in a lamp voltage modulation detector 41, which can be a simple envelope detector known to the skilled person, to provide a lamp voltage envelope 43 to an analysis unit 44, which analyses the lamp voltage envelope 43 to determine a required phase shift and amplitude correction for the lamp power and to generate an appropriate power correction signal 45 for the power correction unit 8. As mentioned already, the analysis unit 42 can utilise a LUT or an algorithm for deriving the phase/amplitude correction on the basis of the relationship described in FIG. 4 above.

The lamp driver 3, in addition to or as an alternative to the lamp voltage analysis, can analyse the light output of the lamp 1. In such a realisation, the lamp driver 3 comprises a light modulation detector 52 for processing measured lamp light values 51 delivered by a light sensor 50, which can be placed close to the light source 1 or in the base of a lighting assembly or in any other suitable position. The light modulation detector 52 determines whether any fluctuation in light output is characteristic of a mechanically induced impact, and delivers appropriate power correction signals 53 to the power correction unit 8.

In addition to or as an alternative to the analysis approaches described above, the lamp driver 3 can analyse a proper acceleration of the lamp 1. In such a realisation, the lamp driver 3 comprises a lamp vibration determination module 62 for processing measured lamp acceleration values 61 delivered by an accelerometer 60. The lamp vibration determination module 62 determines a frequency of fluctuation in light output as a result of a sudden acceleration of the lamp, and delivers appropriate information 63 to an amplitude and phase adaptation unit 64, which can use information stored in a LUT, for example, to determine a suitable phase shift and amplitude correction for the lamp power. The amplitude and phase adaptation unit 64 accordingly generates an appropriate power correction signal 65 for the power correction unit 8.

In the above description for FIG. 5, for the sake of simplicity, the lamp driver 3 is shown to include several analysis means. Evidently, the lamp driver 3 can be realised to perform only lamp voltage analysis, only light output analysis, only acceleration analysis, or any combination of these techniques. The data processing steps such as lamp voltage analysis, light output analysis, acceleration analysis, phase shift and amplitude correction, etc., can be carried out by suitable software algorithms running on a microprocessor or microcontroller of the lamp driver 3.

Figure 6:
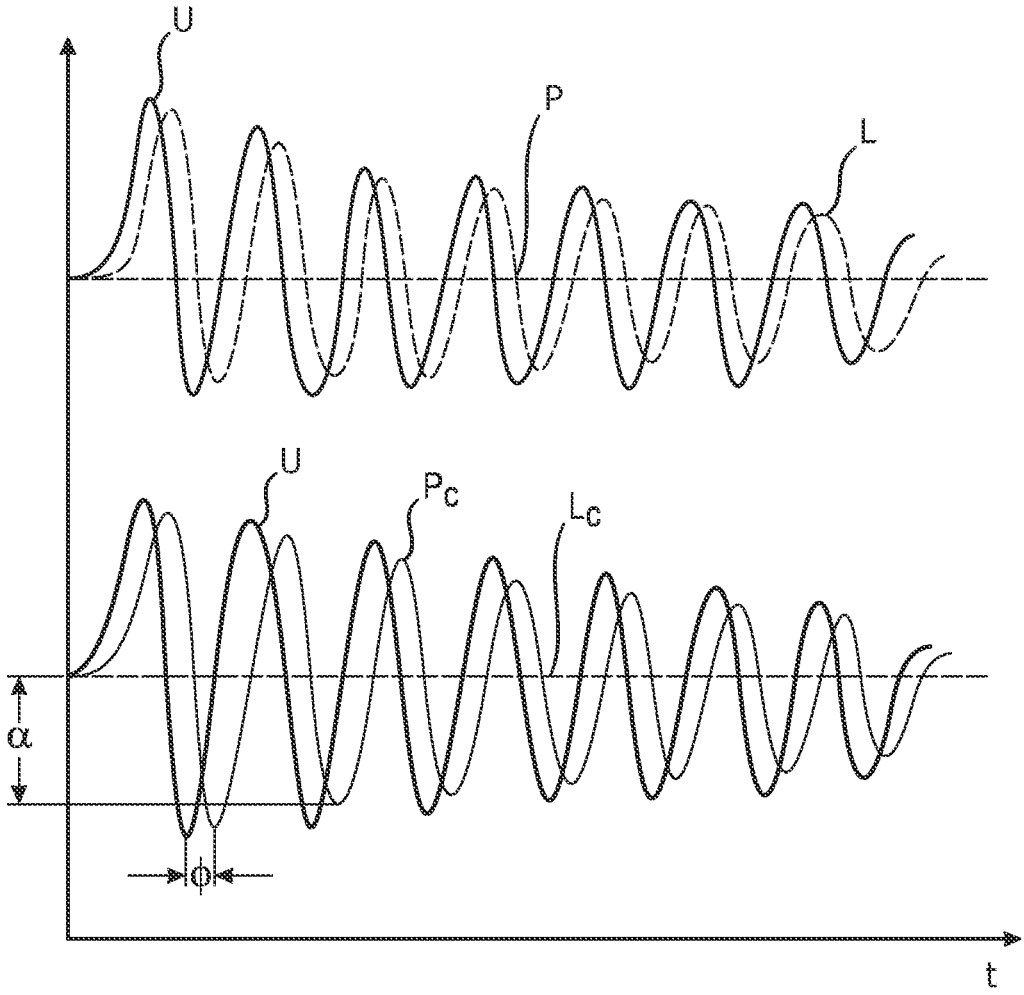
FIG. 6 shows simplified graphs of lamp voltage, lamp power and light output for a prior art lamp and a lamp driven using the method according to the invention.

FIG. 6 shows simplified graphs of modulated lamp voltage U, lamp power P, $P_C$ and modulated light output L, $L_C$ for a lamp driven using a prior art method and a lamp driven using the method according to the invention. In the upper part of the graph, the light output L for a lamp driven using a prior art method is shown. After a mechanical impact, the discharge arc is disturbed and causes the lamp voltage to fluctuate. Values of lamp voltage measured at certain points during the lamp period show a fluctuation that can be graphed as the modulated lamp voltage U shown. The prior art lamp driver attempts to maintain a constant power P. As a result, the light output of the lamp fluctuates, and the modulated light output L is shown to follow the modulated lamp voltage U by a time delay or phase shift. When such a lamp is driven by the method according to the invention, the modulated lamp voltage U is analysed to determine a lamp power correction. By applying the lamp power correction to take into account the phase shift $\phi$ and an amplitude $\alpha$, the corrected lamp power $P_C$ rapidly leads to a settling of the light output $L_C$. In this way, a mechanically induced impact or a sudden change in velocity that causes the discharge arc to be disturbed will not be followed by a perceptible flicker in the forefront of the vehicle. Any flicker in the light output is suppressed so quickly that it may not be apparent to an observer.

Figure 7:
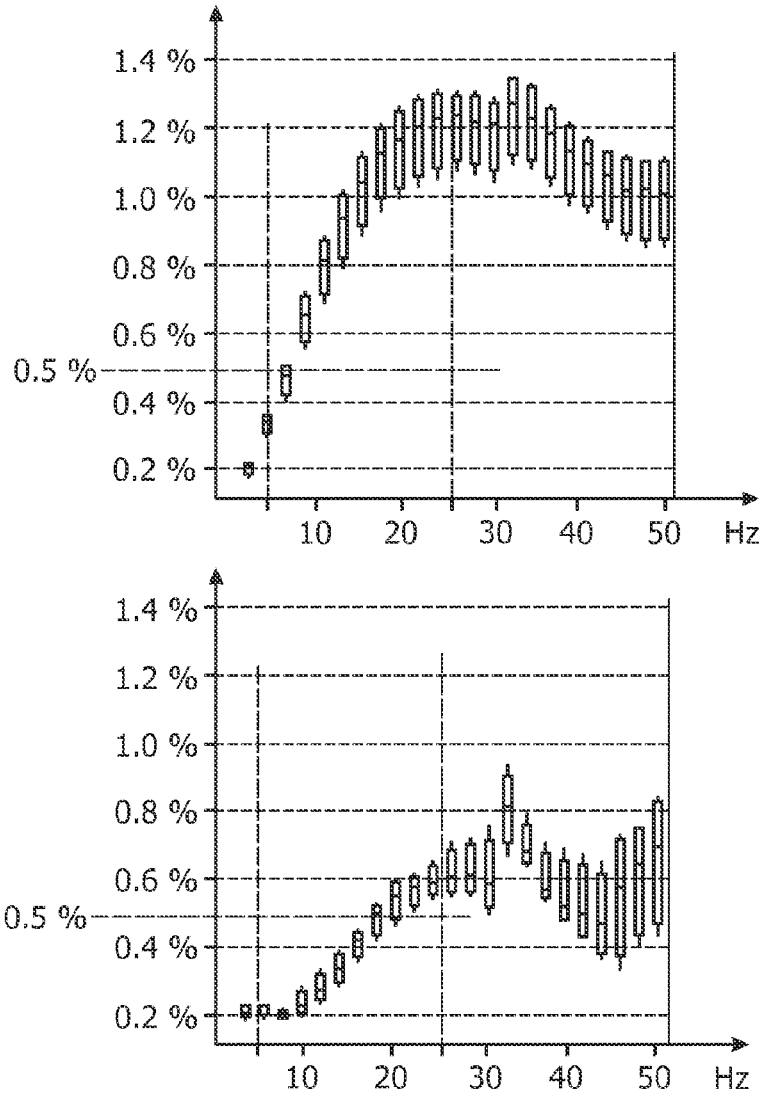
FIG. 7 shows box-plots of light modulation for a lamp driven by a prior art method and by the method according to the invention.

FIG. 7 shows box-plots of light modulation for a lamp driven by a prior art method (upper part of diagram) and for a lamp driven by the method according to the invention (lower part of diagram). An abrupt mechanically induced impact will alter the length of the discharge arc, leading to a fluctuation of the lamp voltage. The frequency components of the fluctuation will depend on the detailed 'shape' of the impact, since an impact or impulse can be expressed as the sum of its Fourier components. In the tests carried out, impacts to a headlamp were simulated by subjecting the headlamp to sinusoidal vibrations at different frequencies and a fixed amplitude. Depending on the actual nature of the impact, the various frequency components contribute to varying degrees to the voltage and light modulation. For the lamp driven using a prior art method which attempts to maintain a constant current, it can be seen that the higher the frequency, the higher will be the modulation of the light flux. At a frequency of about 5 Hz, the light output is already modulated by over 0.4%. At frequencies around 25 Hz, however, the light modulation increases to about 1.2%. The degree of modulation within this range of frequencies (indicated by the broken lines), with the associated perceptible flicker in the forefront of a vehicle, is easily perceptible to an observer and can be annoying and distracting, and therefore a safety hazard. In contrast, the lamp driven using the method according to the invention can suppress the light output fluctuations to a level below which the flicker is essentially not perceptible. At low frequencies around 5 Hz, the fluctuation in light output is very favourably suppressed to about 0.2%. Even at higher frequencies around 20 Hz, the fluctuation in light output seldom exceeds 0.5%. For a noticeable forefront flicker to arise, the impact to the lamp would have to be considerably stronger, for example two to three times stronger in the 20-25 Hz range. This demonstrates that the method according to the invention is favourably effective in suppressing forefront flicker, especially in the indicated frequency range 5-25 Hz to which the human eye is particularly sensitive. The experiments carried out to collect the data showed that the method according to the invention for correcting the lamp power was still effective even for an advanced lamp age in the region of 2000 hours of operation.

Figure 8:
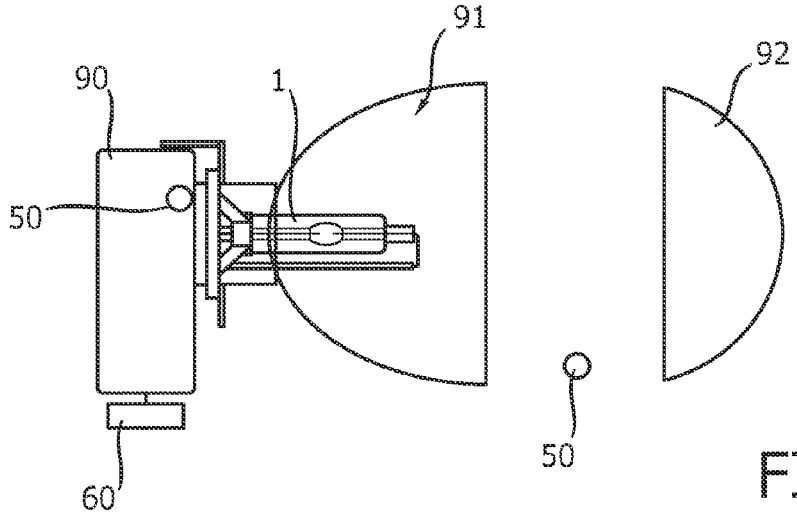
FIG. 8 shows a schematic representation of a lighting assembly according to the invention.

FIG. 8 shows a schematic representation of a lighting assembly 9 according to the invention. Here, a lamp 1 is mounted on a lamp base 90, in a reflector 91 and behind a projection lens 92. Circuitry for the lamp driver 3 can be incorporated in the base 90. The lighting assembly can include a light sensor 50 located in front of the lamp 1 or in the lamp base 90 (both positions are shown for clarity, but a single light sensor 50 is sufficient). In addition to or as an alternative to the light sensor 50, the light assembly can include an accelerometer 60 located at a suitable position for detecting an acceleration of the lamp 1.

Although the present invention has been disclosed in the form of preferred embodiments and variations thereon, it will be understood that numerous additional modifications and variations could be made thereto without departing from the scope of the invention. For example, the driver may include an additional monitoring unit to track the lamp lifetime and make minor adjustments to the lamp power correction algorithm(s) used by the driver so that a lamp aging can be taken into account when correcting the lamp power.

For the sake of clarity, it is to be understood that the use of "a" or "an" throughout this application does not exclude a plurality, and "comprising" does not exclude other steps or elements. A unit or module can comprise other units or modules.

The invention claimed is:

1. A method of driving an arc-discharge lamp (1), which method comprises the steps of:

detecting a mechanically induced fluctuation in luminous flux of the lamp (1) occurring as a result of a physical displacement of the discharge arc (2);

determining a characteristic (43, 51, 63) of the mechanically induced fluctuation in luminous flux of the lamp (1); and adjusting the lamp power on the basis of the determined characteristic (43, 51, 63) to suppress the mechanically induced fluctuation in luminous flux of the lamp (1).

2. A method according to claim 1, wherein the step of detecting a mechanically induced fluctuation in luminous flux of the lamp (1) comprises detecting fluctuations in a frequency range between 5 Hz and 30 Hz.

3. A method according to claim 1, wherein the mechanically induced fluctuation in luminous flux of the lamp (1) is detected by monitoring the lamp voltage to obtain a lamp voltage value (41).

4. A method according to claim 3, wherein the characteristic (43) of the mechanically induced fluctuation in luminous flux of the lamp (1) comprises a lamp voltage modulation envelope (43), which lamp voltage modulation envelope (43) is derived from a sequence of lamp voltage values (41).

5. A method according to claim 1, wherein a mechanically induced fluctuation in luminous flux of the lamp (1) is detected by monitoring an acceleration of the lamp (1) to obtain a lamp acceleration value (61).

6. A method according to claim 5, wherein the characteristic (63) of the mechanically induced fluctuation in luminous flux of the lamp (1) comprises a lamp vibration value (63), which lamp vibration value (63) is derived from a sequence of lamp acceleration values (61).

7. A method according to claim 1, wherein the step of adjusting the lamp power comprises applying a phase-shift ($\phi$) to the lamp power, which phase-shift ($\phi$) is determined on the basis of the determined characteristic (43, 63).

8. A method according to claim 1, wherein the characteristic (51) of the mechanically induced fluctuation in luminous flux of the lamp (1) comprises a measured light output value (51) of the lamp (1).

9. A method according to claim 1, wherein the step of adjusting the lamp power comprises adjusting the amplitude of the lamp voltage and/or the lamp current on the basis of the determined characteristic (43, 51, 63).

10. A driver (3) for an arc-discharge lamp (1), which driver comprises:

a detecting means (40, 50, 60) for detecting a mechanically induced fluctuation in luminous flux of the lamp (1) occurring as a result of a physical displacement of the discharge arc (2);

a determination unit (42, 50, 62) for determining a characteristic (43, 51, 63) of the mechanically induced fluctuation in luminous flux of the lamp (1); and an adjustment unit (8) for adjusting a lamp power ($P_C$) on the basis of the determined characteristic (43, 51, 63) to suppress the mechanically induced fluctuation in luminous flux of the lamp (1).

11. A driver according to claim 10, wherein the detecting means (40) comprises a voltage measurement means (40) for obtaining a lamp voltage value (41) and/or a light sensor (50) for obtaining a lamp light output value (51) and/or a lamp acceleration sensor (60) for obtaining a lamp acceleration value (61).

12. A driver according to claim 10, wherein the determination unit (42, 50, 62) comprises a lamp voltage modulation detector (42) and/or a light sensor (50) and/or a lamp vibration determination module (62).

13. A driver according to claim 12, wherein the light sensor (50) is positioned in a base unit of the lamp (1).

14. A lighting assembly (9) comprising a high-intensity gas-discharge lamp (1) and a driver (3) according to claim 10 for driving the lamp (1).

* * * * *